United States Patent [19]

Smith

[11] Patent Number: 4,969,604

[45] Date of Patent: Nov. 13, 1990

[54] NOZZLE ASSEMBLY

[75] Inventor: Lawrence William Smith, Northville, Mich.

[73] Assignee: IMT Corporation, Northville, Mich.

[21] Appl. No.: 368,053

[22] Filed: Jun. 16, 1989

Related U.S. Application Data

[63] Continuation of Ser. No. 102,132, Sep. 28, 1987, abandoned.

[51] Int. Cl.[5] ..... B05B 15/08

[52] U.S. Cl. ..... 239/588; 222/527; 285/223

[58] Field of Search ..... 239/169, 175, 587, 588, 239/600, 288–288.5; 285/223; 901/43, 49; 222/527

[56] References Cited

U.S. PATENT DOCUMENTS

| | | | |
|---|---|---|---|
| 1,016,281 | 2/1912 | Lundquist | 239/588 |
| 2,185,741 | 1/1940 | Sorg et al. | 222/527 |
| 2,804,243 | 8/1957 | Davenport | 222/527 |
| 3,478,967 | 11/1969 | Horton et al. | 239/175 |
| 3,759,445 | 9/1973 | King | 239/588 |
| 4,018,386 | 4/1977 | Barichello | 239/588 |
| 4,314,717 | 2/1982 | Bjurnman | 239/588 |
| 4,655,674 | 4/1987 | Kohler et al. | 901/49 |

FOREIGN PATENT DOCUMENTS

| | | | |
|---|---|---|---|
| 3331244 | 3/1985 | Fed. Rep. of Germany | 901/49 |
| 314408 | 9/1934 | Italy | 239/588 |

*Primary Examiner*—Andres Kashnikow
*Assistant Examiner*—Michael J. Forman
*Attorney, Agent, or Firm*—Harness, Dickey & Pierce

[57] ABSTRACT

A nozzle assembly for discharging a desired substance such as adhesives is disclosed. The nozzle assembly includes a mechanism for discharging a substance. The discharge mechanism is associated with a supply source to introduce the substance into the discharge mechanism. A mechanism is associated with the discharge mechanism to provide the discharge mechanism with resilient movement in response to forces exerted on the discharge mechanism. The mechanism to provide resilient movement deflects in response to forces applied to the discharge mechanism. The mechanism to provide resilient movement returns the discharge mechanism to substantially the original position of the discharge mechanism before the forces were exerted on the discharge mechanism. The mechanism to provide resilient movement is substantially rigid when the assembly is in a non-deflected position.

10 Claims, 1 Drawing Sheet

NOZZLE ASSEMBLY

This is a continuation of U.S. patent application Ser. No. 102,132, filed Sept. 28, 1987, entitled "Nozzle Assembly" now abandoned.

BACKGROUND AND SUMMARY OF THE INVENTION

The present invention relates generally to discharging apparatus and, more particularly, to an improved nozzle assembly.

In the robotic field, nozzle assemblies are utilized to discharge substances such as adhesives onto the surface of work pieces, panels or the like. Present art nozzles that are used to discharge adhesives onto these surfaces are generally rigidly secured in a robotic arm and lack flexible movement. When these nozzles contact protrusions, discontinuities, or the like on the surface, the nozzle does not flex or deflect to accommodate the protrusion on the surface. Thus, the contact between the nozzle and surface protrusion may cause the nozzle to be broken, damaged, or otherwise rendered non-useable.

It is an object of the present invention to overcome the disadvantages of the above art. The present invention provides the art with a nozzle that may deflect or flex when it encounters protrusions or the like on a work piece surface. The present invention enables a nozzle to deflect in response to external forces, return to substantially its original position and continue to follow the original path of the robotic arm. Further, the present invention provides a nozzle which is substantially non-flexible when external forces are not applied to the nozzle.

Accordingly, the present invention provides the art with a new and improved nozzle assembly. The nozzle assembly of the present invention includes a mechanism to discharge a substance such as an adhesive onto a work piece surface. The discharge mechanism is associated with a supply source to introduce the substance into the discharge mechanism. A second mechanism, associated with the discharge mechanism, provides the discharge mechanism with resilient movement in response to external forces exerted on the discharge mechanism.

The mechanism that provides resilient movement, deflects in response to external forces applied onto the discharge mechanism. After deflection, the mechanism that provides resilient movement returns the discharge mechanism back to substantially the original position of the discharge mechanism, with respect to the robot arm, prior to the exertion of force onto the discharge mechanism.

From the subsequent description and the appended claims taken in conjunction with the accompanying drawings, additional objects and advantages of the present invention will become apparent to one skilled in the art.

DETAILED DESCRIPTION OF THE PREFERRED EMBODIMENT

Figure 1:
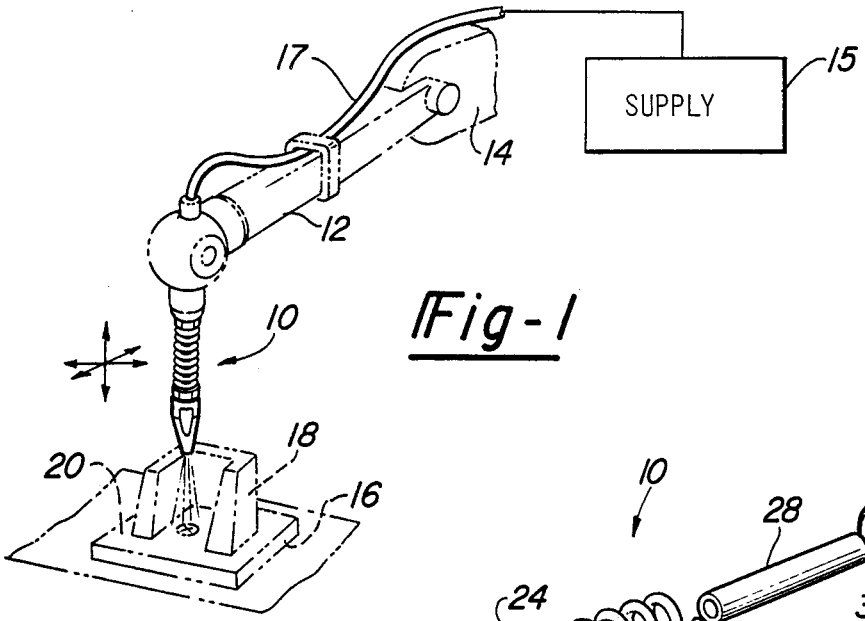
FIG. 1 is a perspective view of a nozzle assembly in accordance with the present invention associated with a robotic apparatus.

Referring to the Figures, a nozzle assembly is shown and designated with the reference numeral 10. Referring to FIG. 1, the nozzle assembly 10 is shown associated with an arm 12 of a robotic apparatus 14 and a supply source 15 via conduit 17. In FIG. 1, the nozzle assembly 10 is illustrated discharging a substance such as an adhesive or the like onto a work piece 16 having a protrusion 18 on its surface 20. If the nozzle assembly 10 contacts the work piece protrusion 18, the nozzle assembly 10 deflects, in accordance with the direction of the arrows, as the robotic arm 12 moves the nozzle assembly 10 around the protrusion 18. While the nozzle is deflecting, it continues to discharge the desired substance onto the work piece surface 20 without interruption.

Figure 2:
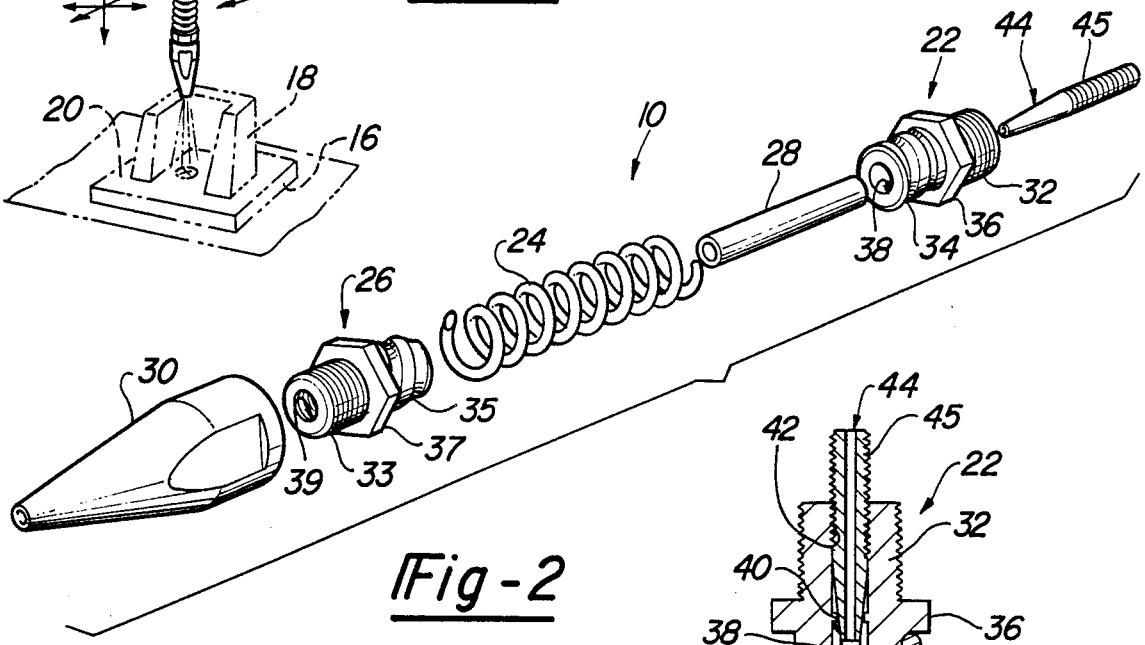
FIG. 2 is an exploded perspective view of a nozzle assembly in accordance with the present invention.
Figure 3:
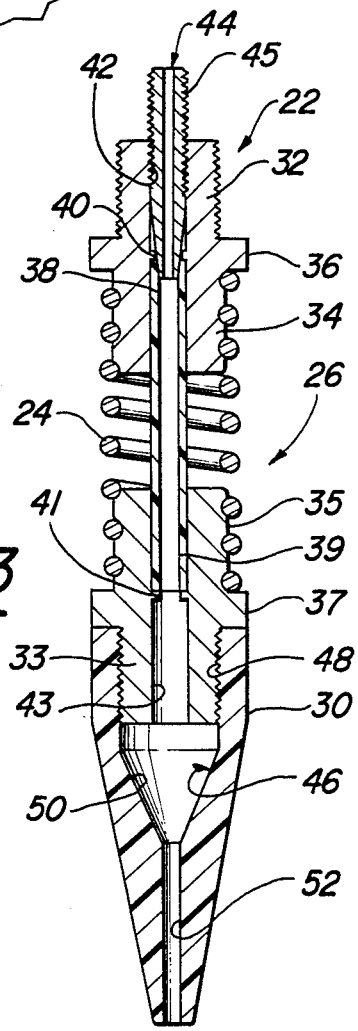
FIG. 3 is a cross-section view of the nozzle assembly.

For a better understanding of the nozzle assembly 10, refer to FIGS. 2 and 3. In the Figures, the nozzle assembly 10 includes a coupling member 22 to associate the nozzle assembly 20 with the robotic arm 12. A resilient member 24 is associated with the coupling member 22 and a second coupling member 26 to provide the nozzle assembly 10 with resilient omnibus deflection characteristics. A conduit 28 is surrounded by the resilient member 24 and is associated with both coupling members 22 and 24 to enable passage of the substance to be discharged from the supply source 15 through the assembly 10 to the nozzle tip member 30.

Referring to FIGS. 2 and 3, the coupling members 22 and 26 are substantially identical and the following discussion will refer to both members. It will be noted that the even reference numerals will refer to coupling member 22 and the odd reference numerals will correspond to identical elements of coupling member 26.

The coupling members 22 and 26 are generally coupling fittings having a threaded portion 32 and 33 to associate the coupling members 22 and 26 with the robotic arm 12 and nozzle tip member 30, respectively. Portions 34 and 35 associate the coupling members 22 and 26 with the resilient member 24. The portions 34 and 35 are generally threaded and have a thread pitch substantially larger than the threaded portions 32 and 33 to receive the resilient member 24. Hex portions 36 and 37 are positioned between the threaded portions 32 and 34 and 33 and 35, respectively, to enable tighting of the coupling members 22 and 26 onto the resilient member 24, the robotic arm 12, and the tip member 30.

The coupling members 22 and 26 have bores 38 and 39, therethrough, to enable passage of the substance to be discharged from the supply source 15 to the spray tip 30. The conduit 28 is positioned in the bore in portions 34 and 35 of members 22 and 26, respectively. Flanges 40 and 41 project into the bores 38 and 39 at the hex portion 36 and 37 to seat and to prevent further insertion of the conduit 28 into the coupling members 22 and 26. The bores 38 and 39 have threaded portions 42 and 43 in the threaded portions 32 and 33 of the coupling members 22 and 26. The threaded bore portion 42 of coupling member 22 enables a nozzle 44, having external thread 45, to be positioned in the threaded portion 42 of the bore 38 to enhance passage of the substance to be discharged through the conduit 28.

The conduit 28 is generally formed from a polymeric material and has desired deflection properties. As the nozzle assembly 10 deflects, the conduit 28 conforms to the deflection of the nozzle assembly 10. The conduit 28 then returns to its original non-flexed position after the deflection has taken place.

The nozzle tip 30 has an overall conical shape with a bore 46 therethrough. The bore 46 has a threaded portion 48 to enable the tip member 30 to be associated with the threaded portion 33 of coupling member 26. The bore 46 includes a conical portion 50 coupled with the threaded portion 48 and a third portion 52 coupled with the conical portion 50. The third portion 52 is generally smaller in diameter than the threaded portion 48 and has a desired diameter size to provide the tip member 30 with optimum discharge characteristics. Thus, the tip member 30 provides the nozzle assembly 10 with a desired stream of the substance to be discharged onto the work piece surface 20.

The resilient member 24 is generally a helical spring having desired deflection, tension, and compression characteristics. The resilient spring member 24 enables the nozzle assembly 10 to deflect a desired amount in response to external forces applied to the tip member 30. Generally, the spring wire used to manufacture the spring has a diameter of about .105 inch and is coiled with about six coils per inch. However, any size or spring wire or number of coils per inch may be used which provide the spring with desired deflection, tension, compression characteristics and also provides substantial rigidity in a non-flexed position.

When a force is applied to the tip member 30 which exceeds a desired magnitude, the resilient member 24 omnibusly deflects with respect to or along its longitudinal axis, whichever is desired as seen by the arrows in FIG. 1. Also, when the nozzle assembly 10 is in a non-deflected position, the resilient member 24 provides the nozzle assembly 10 with substantial rigidity to enable desired discharging of the substance as the robotic arm 12 travels along its path. Thus, once the nozzle assembly 10 has been deflected, the resilient member 24 returns the nozzle assembly 10 back to substantially the original position of the nozzle assembly 10 before deflection.

The substance to be discharged from the nozzle assembly 10 generally passes from the supply source 15, through conduit 17, into and through the coupling member 22, conduit 28, coupling member 26, and the nozzle tip member 30. The substance to be discharged, such as adhesives or the like, is generally under pressure and discharges out of the tip member 30 in a desired fashion.

While the above summarizes the present invention, it will become apparent to the skilled artisan that modifications, variations and alterations may be made to the present invention without deviating from the scope and fair meaning of the subjoined claims.

What is claimed is:

1. A nozzle assembly comprising:

means for discharging a substance associated with a supply source for introducing said substance into said discharge means, said means including:

a tip member having an exposed end and an internal bore therethrough, said bore includes a threaded portion;

a first member having a bore therethrough, a threaded portion threadably engaging said tip member threaded bore and a coupling portion;

a second member having a bore with an interior threaded portion therethrough, a portion associated with said supply source and a coupling portion;

means for providing a passage for said substance to pass said substance from said supply source to said tip member; and means for providing said discharge means with resilient movement in response to forces exerted on said tip member, said resilient means having a single resilient member substantially enclosing said passage means and coupled with said coupling portions of said first and second members, said resilient member having a diameter substantially the same as said first and second members and being of sufficient size so as to provide a substantial space between said passage means and said resilient member when said resilient member is in an unflexed position, said resilient member further contacting said coupling portion of said first member so as to be substantially adjacent said exposed end of said tip member; and a nozzle with exterior threads threadably engaging the interior threaded portion of said bore of said second member for providing said substance to said passage means and said tip member.

2. The nozzle according to claim 1 wherein said means for providing resilient movement deflects in response to forces applied to said discharge means having a magnitude greater than a predetermined magnitude and said means for providing resilient movement returning said discharge means to substantially its original position before said forces were exerted on said discharge means.

3. The nozzle assembly according to claim 2 wherein said resilient member is a helical spring.

4. The nozzle assembly according to claim 1 wherein said resilient member is a helical spring associated with said first and second members and substantially enclosing said passage means for providing said nozzle assembly with resilient movement.

5. The nozzle assembly according to claim 1 wherein said first and second members are substantially identical.

6. A robotic apparatus in combination with a nozzle assembly comprising:

a movable arm, a supply source, a conduit means coupled to the supply source, and a nozzle assembly coupled with the arm and supply source;

said nozzle assembly including:

a tip member having an internal bore therethrough, said bore includes a threaded portion;

a first member having a bore therethrough, a threaded portion threadably engaging said tip member threaded bore and a coupling portion;

a second member having a bore with an interior threaded portion therethrough, a portion associated with said supply source and a coupling portion;

means for providing a passage for said substance to pass said substance from said supply source to said tip member, said passage means coupled with said bores of said first and second members;

means for providing said discharge means with resilient movement in response to forces exerted on said tip member, said resilient means having a single resilient member substantially enclosing said passage means and coupled with said coupling portions of said first and second members, said resilient member having a diameter substantially the same as said first and second members and being of sufficient size so as to provide a substantial space between said passage means and said resilient member when said resilient member is in an unflexed position; and a nozzle with exterior threads threadably engaging the interior threaded portion of said bore of said second member for providing said substance to said passage means and said tip member.

7. The nozzle assembly according to claim 6 wherein said resilient member is a helical spring associated with said first and second members and substantially enclosing said passage means for providing said nozzle assembly with resilient movement.

8. The nozzle assembly according to claim 6 wherein said first and second members are substantially identical.

9. The nozzle assembly according to claim 6 wherein said resilient member is a helical spring.

10. A nozzle assembly comprising:

a tip piece having an internal bore, said internal bore having a threaded portion;

a first connecting piece having an internal bore, a first end of said first connecting piece having an external threaded portion for threadably engaging said threaded portion of said tip piece, a nut adjacent said first end of said first connecting piece for inserting said first connecting piece into said tip piece, a second end adjacent said nut and opposite said first end of said first connecting piece, and said internal bore of said first connecting piece having a flange;

a tube having an internal opening therethrough, a first end of said tube being inserted into the second end of said first connecting piece and resting against said flange of said first connecting piece;

a second connecting piece having an internal bore, a first end of said second connecting piece having an external threaded portion, said first end of said second connecting piece further having an internal threaded portion, a nut adjacent said first end of said second connecting piece, a second end of said second connecting piece adjacent said nut of said second connecting piece and opposite said first end of said second connecting piece and said internal bore of said second connecting piece having a flange, a second end of said tube being inserted into said second end of said second connecting piece and resting against said flange of said second connecting piece;

a helical spring substantially enclosing said tube, a first end of said spring connected to the outer periphery of said second end of said first connecting piece, a second end of said spring connected to the outer periphery of said second end portion of said second connecting piece; and a nozzle threadably engaged with the internal threaded portion of said first end of said second connecting piece;

wherein, by means of said spring, said tip piece will deflect in all directions when said tip piece encounters a force.

* * * * *